US005425210A

United States Patent [19]

Zafir

[11] Patent Number: 5,425,210

[45] Date of Patent: Jun. 20, 1995

[54] INSULATED PANEL

[76] Inventor: George Zafir, 8500 Keele Street, Concord, Ontario, Canada, L4K 2A6

[21] Appl. No.: 88,354

[22] Filed: Jun. 9, 1993

[30] Foreign Application Priority Data

Aug. 7, 1992 [CA] Canada ..... 2075553

[51] Int. Cl.[6] ..... E04B 1/74

[52] U.S. Cl. ..... 52/404.4; 52/309.4; 52/309.9; 52/592.1; 52/592.4; 52/478; 52/483.1

[58] Field of Search ..... 52/309.9, 404.4, 592.1, 52/592.4, 309.2, 511, 309.4, 309.9, 404.4, 592.1, 592.4, 478, 483.1

[56] References Cited

U.S. PATENT DOCUMENTS

| | | | |
|---|---|---|---|
| 3,760,548 | 9/1973 | Sauer et al. | 52/592.1 |
| 3,797,190 | 3/1974 | Widdowson | 52/592.4 |
| 4,037,377 | 7/1977 | Howell et al. | 52/309.9 |
| 4,100,710 | 6/1978 | Kawalliz | 52/309.9 |
| 4,304,083 | 12/1981 | Anderson | 52/309.9 |
| 4,571,909 | 2/1986 | Beughuis et al. | 52/309.9 |
| 4,976,082 | 12/1990 | Bard | 52/511 |

*Primary Examiner*—Carl D. Friedman
*Assistant Examiner*—Christopher Todd Kent
*Attorney, Agent, or Firm*—Borden & Elliot

[57] ABSTRACT

Common problems with composite panels of the foam core and metal facing type include water infiltration, failure to survive fire testing, and fragility. A relatively simple panel which affords a solution to the above mentioned problems includes a foam core with inner and outer metal facings thereon, a pair of spaced apart projections extending longitudinally of one side of the core defining male connectors, a pair of longitudinally extending, spaced apart grooves in the other side of the core defining female connectors for receiving the projections, the inner and outer facings terminating in the areas between the connectors so that there is core to core and metal to metal contact when panels are interconnected, a recess in an outer corner of the male connector side of the core, and a flange on the other side of the panel, whereby, when panels are interconnected side edge to side edge, the flange overlaps the recess leaving an expansion gap for fasteners, which are covered by the flange. Panels can be assembled to extend horizontally, in which case the bottom edge of the recess is inclined outwardly and downwardly to facilitate the escape of water from the gap.

10 Claims, 5 Drawing Sheets

INSULATED PANEL

BACKGROUND OF THE INVENTION

1. Field of the Invention

This invention relates to a building panel, and in particular to a composite panel of the type including a foam plastic core and metal facings.

2. Discussion of the Prior Art

Panels of the type described herein include a polyurethane foam core and metal facings, and are normally used to construct cold storage areas, for example in the food and fishery industries. Typically, the panels are approximately four feet wide and as high as an entire building, e.g. 25 to 30 feet. The thickness of the cores of the panels is determined by the amount of insulation required. Panels of this type are frequently constructed with flat side edges which abut each other. This construction provides very little strength at the joint. Also, in panels of this type, it is desirable to minimize air and water infiltration and to design the joints between panels to ensure metal to metal, and insulation to insulation contact only. Otherwise, heat or cold is conducted through the panels, or through fasteners used to connect the panels to underlying structural supports. Many prior art panels have unacceptable insulating qualities.

In general, it has not been possible or economical to construct entire buildings using insulated panels for exterior cladding. Such buildings usually include precast concrete panels or corrugated metal siding as exterior cladding. There is a great advantage in having exterior cladding which provides superior insulating qualities than traditional materials. When constructing manufacturing plants or warehouses, relatively thin insulating panels are desirable. However, the panels must have greater structural integrity than that which is available using the simple connection structure of existing insulated panels. The resulting cladding must also be aesthetically pleasing.

Fire represents another problem when using insulating panels as structural cladding. Polyurethane foam is an organic cellular foam which can be degraded by fire. A typical fire test is the ULC Fire Test Type CAN-4-S101-M82. Ordinary insulated panel systems do not survive such fire tests particularly well. The panels tend to open under high heat (approximately 1500° F.) because of flexing of the metal facing sheets. Once a sheet has opened, the foam is quickly degraded by the fire. The problem could be overcome partially by screwing or otherwise externally fastening pieces of metal together. However, the screws or other fasteners would be visible and would adversely affect the appearance of the structure.

Vertical joints are normal and acceptable in insulated walls. In some cases, however, it is desirable to finish a structure with horizontal panels. Horizontal joints are not feasible using existing insulated panels, because water infiltration readily occurs in horizontal panel structures. Buildings are often under negative pressure conditions. Under positive exterior pressure, such as a driving rain storm, water may seep through the gaps between panels to degrade panel insulation, rust metal facings and fasteners and even enter the building. The water can also freeze and expand, harming the insulation, causing leakage into the building, and potentially resulting in rusting of the metal and consequently in staining of the building.

Another objectionable feature of some prior art panels is the presence of loose metal tips, edges or flanges. During shipping and handling, such loose metal pieces can be bent or torn from the foam cores of the panels causing delamination. The loose metal can also damage other panels or other objects. Since it is somewhat difficult to manipulate 30-foot long panels into interlocking engagement, delamination damage to the panels can easily occur during construction particularly when the panels are not perfectly uniform and straight. When being forced together, certain prior art panels tend to become fixed by ratcheting action. For example, edges of the metal facing may lock into the foam core of adjacent panels. Thus, the panels cannot be separated for replacement or re-use without damaging adjoining panels. Moreover, certain prior art structures require caulking in joints between panels which is an extra step in construction and requires maintenance. Also, the existence of gaps in the foam in the middle of the joints or between metal facings in certain prior art panels provides reduced insulation and potential sites for water to collect and infiltrate if caulking fails.

GENERAL DESCRIPTION OF THE INVENTION

One aspect of the present invention is to overcome the problems outlined above by providing a relatively simple, strong composite insulating panel, which can easily and quickly be connected to similar panels and to a support structure to form a wall with strong joints between panels.

Another aspect of the invention is to provide a composite panel which can be connected to similar panels by fasteners hidden from external view.

Yet another aspect of the invention is to produce a panel which can be used to form a wall with generally only metal to metal and core to core contact in the joint areas, and without interior joint gaps capable of trapping water or allowing passage of air.

Yet another aspect of the invention is to produce a panel which can be disconnected and re-used.

Accordingly, the present invention relates to a wall panel comprising elongated, insulating core means; inner metal facing means on one surface of said core means; outer metal facing means on an opposite surface of said core means; first and second spaced apart, longitudinally extending male joint means extending outwardly from one side edge of said core means; groove means between said male joint means; first free ends of said inner and outer facing means extending around outer free ends of said male joint means to locations in the sides of said groove means; said first free ends of the facing means being in contact with said core means along the entire length of the panel; first and second longitudinally extending spaced apart female joint means in the other side edge of said core means for receiving the male joint means of an adjacent similar panel for interconnecting the panels; projection means between said female joint means; second free ends of said inner and outer facing means extending into said female joint means and along the sides of said projection means, whereby there is core means to core means contact in the area between said male and female joint means; flange means defined by said core means and said outer metal facing means extending outwardly from said one side edge of the panel; and recess means in said core means and said outer facing means extending the length of the other side edge of the panel, at least a portion of said recess means being substantially parallel to the outer facing means; said recess means being thicker than said flange means, whereby, when two panels are interconnected side edge to side edge, said flange means of one panel extends into said recess means of the second panel to define a substantially rectilinear continuation of the outer surface of the panels and a flow passage between said flange means and recess means.

BRIEF DESCRIPTION OF THE DRAWINGS

The invention will be described in greater detail with reference to the accompanying drawings, which illustrate preferred embodiments of the invention, and wherein.

DESCRIPTION OF THE PREFERRED EMBODIMENT

Figure 1:
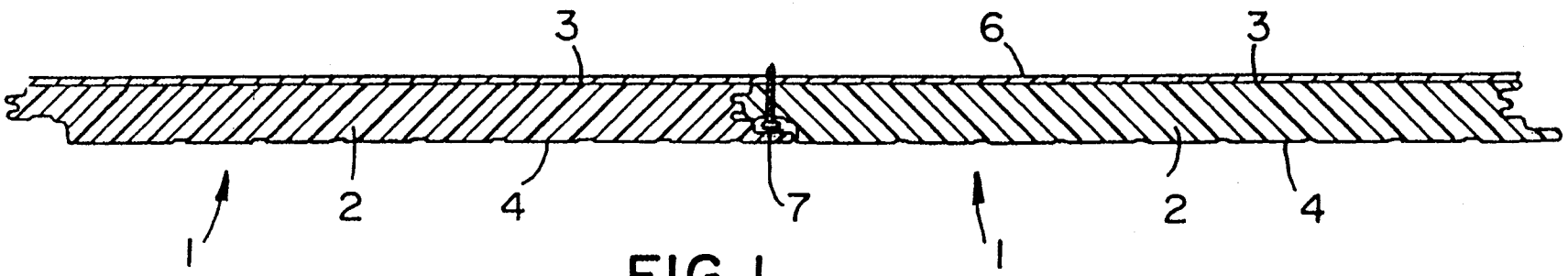
FIG. 1 is a schematic cross-sectional view of a pair of interconnected wall panels in accordance with the invention mounted on a support.
Figure 2:
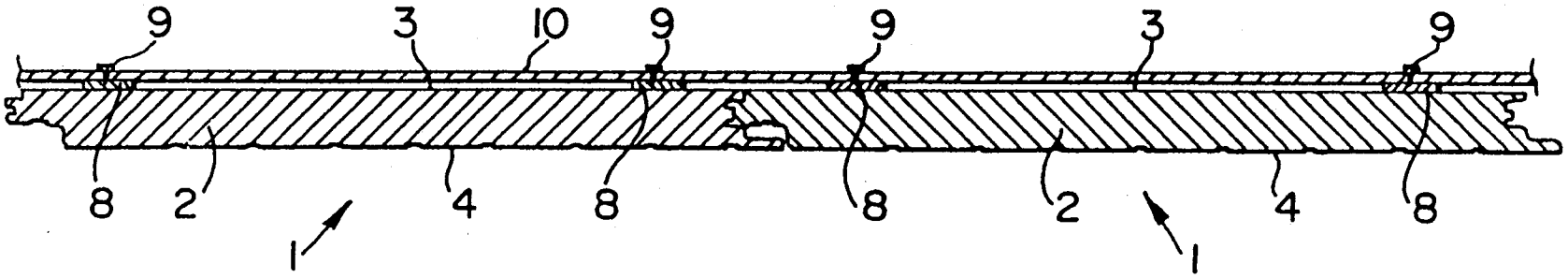
FIG. 2 is a schematic cross-sectional view of slightly modified, interconnected wall panels mounted on a support.

Referring to FIGS. 1 and 2, the panel of the present invention which is generally indicated at 1 includes a foam plastic insulating core 2, and inner and outer metal facings 3 and 4, respectively bonded to the core 2 along the entire length thereof. Adjacent panels 1 are interconnected, and are mounted on a backing plate 6 using self tapping screws 7 (FIG. 1). Alternatively, as shown in FIG. 2, metal strips 8 are bonded to the inner facing 3 and screws 9 are used to connect the panels 1 to horizontal, metal structural supporting strips 10. Of course, the strip 10 can be a concrete or even a wooden structural member, and need not be horizontal or even in the form of a strip.

Figure 3:
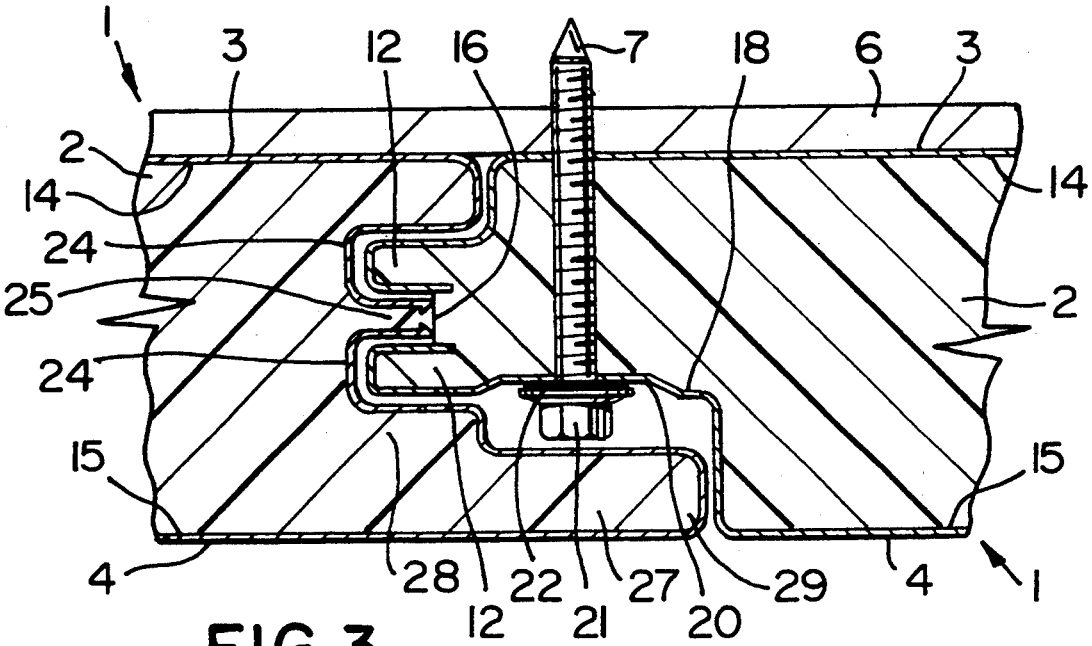
FIGS. 3 to 5 are schematic cross-sectional views of the joints between interconnected similar panels on a larger scale.
Figure 4:
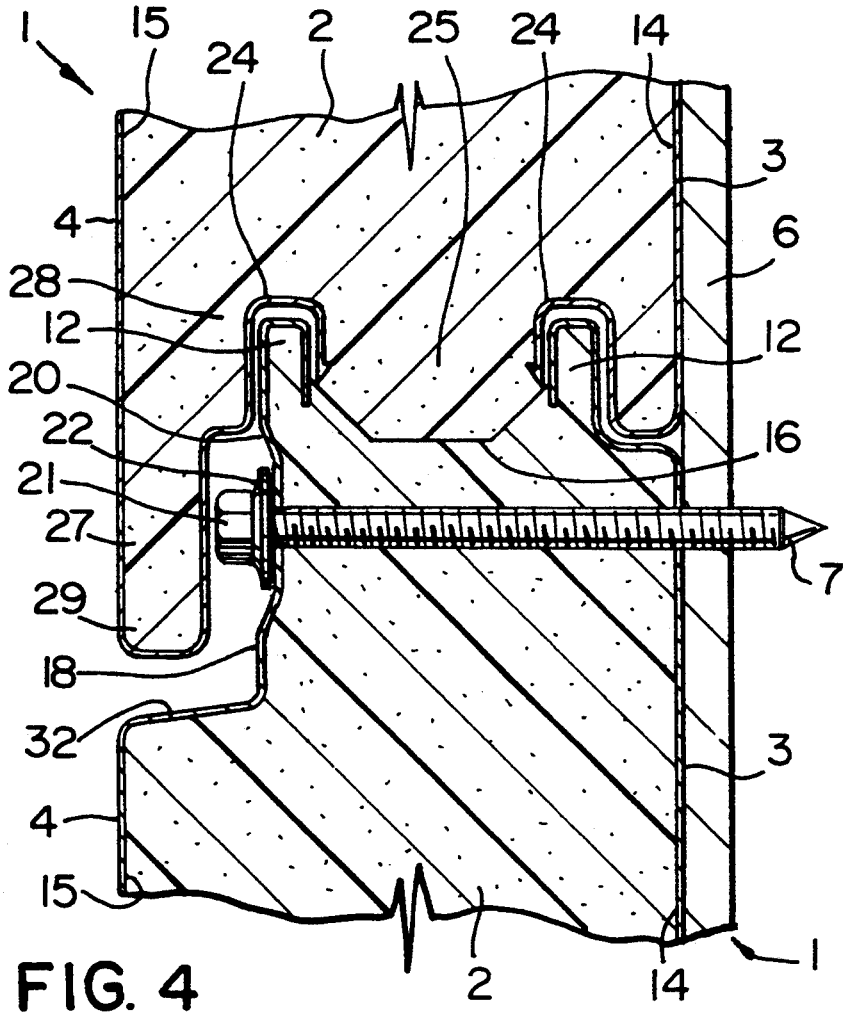
Figure 5:
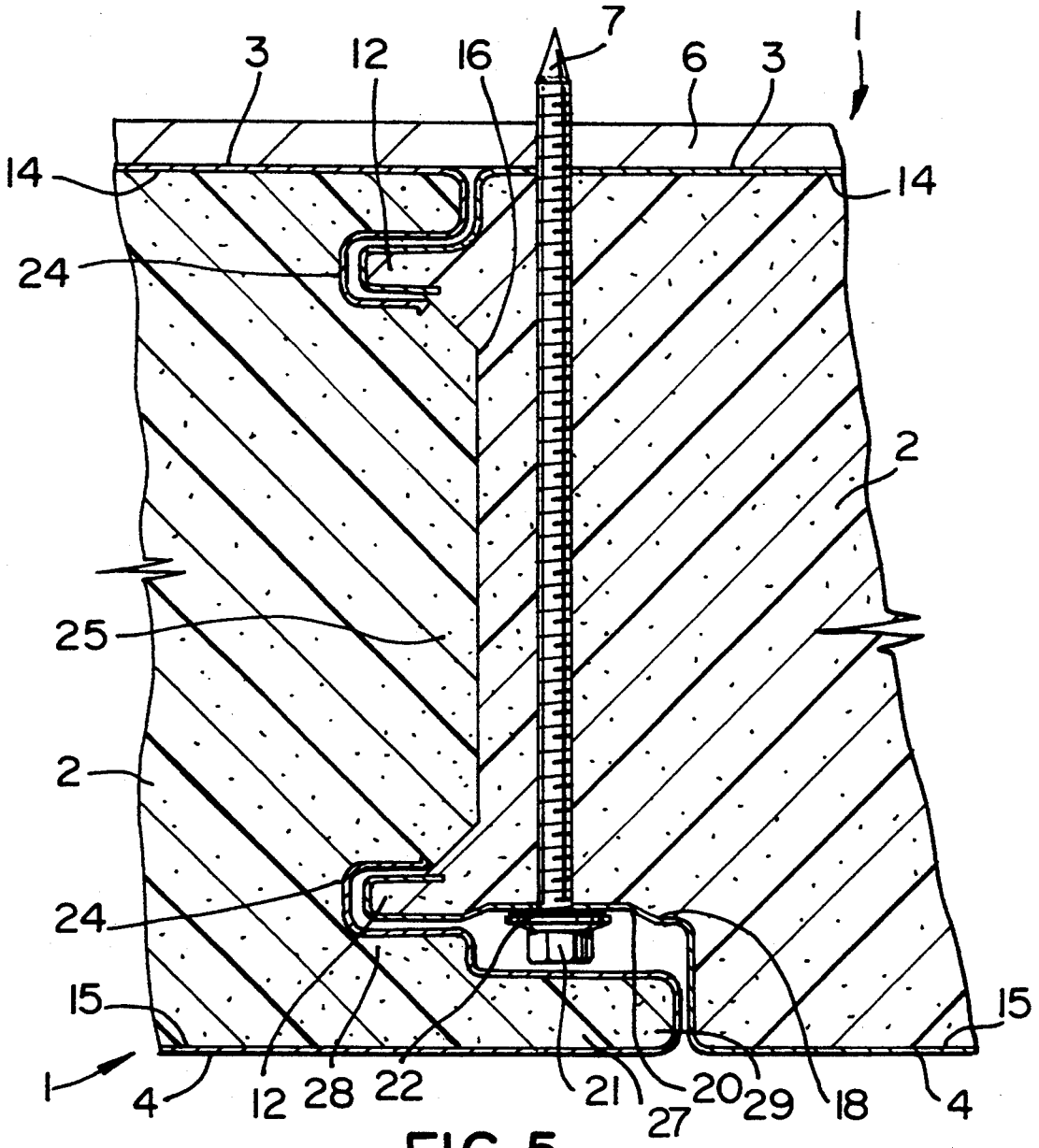

As a further alternative (not illustrated) adjacent panels can be stitch screwed together on their inner facings for minimal loss of insulating properties while retaining an aesthetically pleasing exterior appearance. Using conventional construction methods, panels 1 are added one at a time to form a wall, each panel being interconnected with an existing panel 1 and then connected to the structural support. As illustrated in FIGS. 3 to 5, the panels 1 can extend vertically (FIGS. 3 and 5) or horizontally (FIG. 4).

Referring to FIG. 3, in one embodiment of the panel the foam core 2 includes a pair of male joint members defined by spaced apart, narrow, generally rectangular cross-section projections 12 extending the length of one side edge of the core. The projections 12 are spaced apart from each other and from the inner and outer surfaces 14 and 15, respectively of the core 2. The space between the projections 12 defines a generally rectangular groove 16. A large, generally rectangular recess 18 is provided in the outer surface of the core 2. The recess 18 extends the length of the core 2. The inner facing 3 extends around the inner edge of the core 2, and around one projection 12 into the groove 16. The outer facing 4 extends around the outer edge of the core 2, follows the contour of the recess 18 and extends around the other projection 12 into the groove 16. The ends of the facings 3 and 4 are embedded in the core 2 at the bottom of the groove 16. This prevents both oxidation or rusting of, and damage to, unsupported or unprotected ends of facings. A slight depression 20 extends the length of the inner surface of the recess 18 for receiving an annular flange on the head 21 of the screw 7. The self tapping screw 7 is of the type including a gasket or sealing ring 22 beneath the head 21. Other types of fasteners can also be employed. The use of stainless steel screws reduces rust problems.

The other side edge of the core 2 includes a pair of female joint members defined by narrow, generally rectangular cross-section grooves 24 extending the length of the panel for receiving the male joint members. The grooves 24 are spaced apart by approximately the same distance as the projections 12 on the other side edge of the panel. A projection 25 between the grooves 24 extends into the groove 16 when adjacent panels are interconnected. A flange 27 extends the entire length of the outer side edge of the core 2 for filling a major portion of the recess 18 in an adjacent panel when panels are interconnected. The inner portion 28 of the flange 27 defines one side of the outermost groove 24. The outer portion of free end 29 of the flange 27 is thinner and partially fills the recess 18, providing a cover for the head 21 of the screw 7. The recess also constitutes an expansion chamber to allow any moisture which may penetrate into the recess to flow down the recess and to escape below.

The facings 3 and 4 extend around the inner edge of the core 2 and around the flange 27 into the grooves 24. The facings cover the entire inner surfaces of the grooves. The ends of the facings 3 and 4 are pointed on either side of the projection 25, extending into the projection to provide maximum contact for good bonding of the facings 3 and 4 to the core 2, reducing the likelihood of damage to the ends of the facings, and leaving the outer end of the core projection 25 in contact with core material in the groove 16.

The panel of FIG. 4 is virtually identical to that of FIG. 3, except that it is designed for forming a wall with horizontal seams or joints between panels. Moreover, the male and female joint members (projections 12 and grooves 24) are spaced apart a greater distance than in the panel of FIG. 3. Thus, there is more core to core or insulation to insulation contact in the center of the panel. The groove 16 between the projections 12 is generally bowl-shaped or trapezoidal, and the projection 25 has a corresponding configuration to ensure generally complete core-to-core contact. Any reasonable shapes of such corresponding configurations can be employed.

Another feature of the panel 1 of FIG. 4 is that the bottom 32 of the recess 18 slopes downwardly and outwardly when the panel is in use. Thus, any water entering the recess 18 can flow out of the joint between panels 1. It will be appreciated that the gap between the free end 29 of the flange 27 and the bottom 32 of the recess 18 acts as an expansion passage.

The panels illustrated in FIG. 5 are identical to the panels of FIG. 3, except that the projection 25 of the FIG. 5 panel is substantially thicker than that shown in FIG. 3. Moreover, the projection 25 has a shape similar to the same element in FIG. 4.

Referring to FIGS. 1, 3 and 5, when using the panels 1 with screws 7, a first panel 1 is connected to a support such as a backing plate 6. The screws 7 extend through the panel 1 inside the inner end of the groove 16. A second panel 1 is slid into interconnecting relationship with the first panel, and is then connected to the plate 6 using additional screws 7. The connected panels can be separated and re-used when the screws are removed.

When metal strips 8 are provided on the rear surfaces of the panels (FIG. 2), a first panel is mounted on the structural supporting strips 10 using screws 9. A second panel 1 is slid into interconnecting relationship with the first panel, and is then connected to the strips 10 using additional screws 9. The screws 9 may penetrate the inner facing 3, but do not penetrate the outer facing 4, so that there is no metal heat conductor extending between the facings 3 and 4. Again, suitable fasteners other than screws may be employed.

For each of the panels illustrated in FIGS. 1 to 5, the greater the thickness of the panel, the greater is its insulating value. Panel thicknesses illustrated in FIGS. 1 to 5 are for illustration only. For example, the vertical panels of FIGS. 1 to 3 are relatively thin while the vertical panel of FIG. 5 is relatively thick.

Spaces shown between panels in FIGS. 1 to 5 are for purposes of illustration only. In fact, it is desirable to have generally tight contact between metal surfaces and between foam surfaces on the interior of the panel to maximize the insulating properties of the panels. The exterior gap between panels can be adjusted for ease of construction, water flow characteristics, aesthetic appearance, and other factors.

Although it is possible to provide caulking between panels for added protection from the elements, this is generally not necessary using the present invention. This feature provides real advantages over conventional exterior cladding materials and existing insulated panels since elimination of caulking reduces maintenance and facilitates re-use of the panels.

The panel and wall structures of the invention herein described provide: extreme temperature thermal performance; structural performance in building construction; prevention of oxidation and rusting of metal facing sheet edges; prevention of side joint disengagement and exposure of the core for minimum ten minute duration when subjected to ULC Fire Test Type CAN-4-S101; provision of a side joint design that facilitates handling, shipping and field installation without damage to facing sheets; and side joint design that permits disengagement without distortion and damage to the panel and joint so as to permit re-use of the panels as might be encountered with a building expansion or relocation.

Although any reasonable facing material can be used, preferred facings include painted or galvanized steel, aluminum, fiberglass, and stainless steel of 0.016 inches to 0.050 inches thickness.

With respect to manufacturer of the core, low density (1 to 5 lb/cubic foot) cellular plastic polymer insulation is poured or injected in a viscous state between two facing sheets and allowed to expand to fill the full depth of the insulating panel whilst restrained to a precise dimension in a press. Prior to or during the insulating core expansion process, "edge molds" are positioned along the longitudinal side edges of the panel to permit a precisely formed and permanently molded tongue and groove impression to be left in the insulating core when the edge molds have been removed following full expansion of the insulating core.

To improve thermal performance the panel joint is designed to engage not only matching male and female profiles extended from the metal facing sheets, but also tightly to engage a molded tongue and groove profile formed in the insulation core. The insulation core, thereby resulting in core to core contact engagement is a significant improvement over typical butt-joint insulation contact in the joint.

The interlocking of the tongue and groove insulation core solves the problem of poor insulating characteristics of wall joints particularly for critical high performance uses such as freezer storage buildings and arctic or desert applications.

Structural performance is improved due to the formed metal engagement of matching male and female profiles (grooves and projections). These matching profiles are filled with expanded insulation core material providing increased rigidity and therefore greater stiffness (strength) at the joint. The design solves the problems of unsupported metal tabs delaminating from adjacent insulation, subsequent unrestrained movement within the joint, and diminished structural performance.

For extreme conditions of use, it is sometimes desirable to mechanically fasten (for example, by stitch screwing) adjoining panels together on the interior face. This design has an overlapping of interior face sheets permitting such fastening at the joint.

To eliminate possible oxidation and rusting of metal sheet edges within the joint, which causes staining of the finished exterior exposed facing sheet, this joint design has no exposed edges in that they have been terminated within the insulation core on both female and male matching profiles.

Previously, it has been difficult to comply with certain fire code test procedures that require adequate performance results on both faces of the panel. Overlapping of metal face sheets of adjacent panels on both the interior and exterior faces by a minimum designed amount permits successful fire performance in the ULC (Underwriters Laboratories) CAN-4-S101 Test Procedure. Overlapping of both interior and exterior face sheets of adjacent panels prevents exposure of the insulation core after a ten minute minimum duration of this test.

This joint design also improves prior art designs by eliminating formed metal protecting male edges that are unsupported by surrounding insulation core material. Unsupported male edges have proven to be difficult to handle and ship without damage. Field installation procedures invariably damage the male profile shape and often pull the face sheet away from its bond to the insulation core rendering the panel useless. This design solves the problem by filling all male joint profiles with insulation making them rigid and unsusceptible to damage.

This joint design also allows disengagement for removal between panels without distortion and damage to face sheets and joint profile. This solves a problem encountered with some joint designs that lock or ratchet together when engaged preventing removal without damage. Removal is a feature that permits easy expansion of building walls and re-use of existing panels.

We claim:

1. A wall panel comprising elongated, insulating core means; inner metal facing means on one surface of said core means; outer metal facing means on an opposite surface of said core means; first and second spaced apart, longitudinally extending male joint means extending outwardly from one side edge of said core means; groove means between said male joint means; first free ends of said inner and outer facing means extending around outer free ends of said male joint means to locations in the sides of said groove means; said first free ends of the facing means being in contact with said core means along the entire length of the panel; first and second longitudinally extending spaced apart female joint means in the other side edge of said core means for receiving the male joint means of an adjacent similar panel for interconnecting the panels; projection means between said female joint means; second free ends of said inner and outer facing means extending into said female joint means and along the sides of said projection means, whereby there is core means to core means contact in the area between said male and female joint means; flange means defined by said core means and said outer metal facing means extending outwardly from said one side edge of the panel; and recess means in said core means and said outer facing means extending the length of the other side edge of the panel, at least a portion of said recess means being substantially parallel to the outer facing means; said recess means being thicker than said flange means, whereby, when two panels are interconnected side edge to side edge, said flange means of one panel extends into said recess means of the second panel to define a substantially rectilinear continuation of the outer surface of the panels and a flow passage between said flange means and recess means.

2. A panel according to claim 1, wherein said recess means includes a first side substantially parallel to said outer facing means adapted to receive fasteners for mounting the panel on a supporting surface; and a second side substantially perpendicular to said first side.

3. A panel according to claim 1, wherein said recess means includes a first side substantially parallel to the outer facing means adapted to receive fasteners for mounting the panel on a supporting surface; and a second side defining an obtuse angle with respect to said first side, whereby, when interconnected panels extend horizontally, the flow of water from said passage is facilitated.

4. A panel according to claim 1, wherein said first and second free ends of said inner and outer facing means are embedded within the core means.

5. A panel according to claim 2, including depression means extending the length of said first side of said recess means for receiving a portion of the head of each fastener used to interconnect panels.

6. A panel according to claim 1, including connecting strips on the outer surface of said inner facing means, permitting mounting the panel on a supporting structure without penetration of said outer facing means.

7. A wall structure comprising structural supporting means; a plurality of wall panels interconnected edge to edge; and fastener means for connecting said panels to said structural supporting means, each said wall panel including elongated, insulating core means; inner metal facing means on one surface of said core means; outer metal facing means on an opposite surface of said core means; first and second spaced apart, longitudinally extending male joint means extending outwardly from one side edge of said core means; groove means between said male joint means; first free ends of said inner and outer facing means extending around outer free ends of said male joint means to locations in the sides of said groove means; said first free ends of the facing means being in contact with said core means along the entire length of the panel; first and second longitudinally extending spaced apart female joint means in the other side edge of said core means for receiving the male joint means of an adjacent similar panel for interconnecting the panels; projection means between said female joint means; second free ends of said inner and outer facing means extending into said female joint means and along the sides of said projection means, whereby there is core means to core means contact in the area between said male and female joint means; flange means defined by said core means and said outer metal facing means extending outwardly from said one side edge of the panel; and recess means in said core means and said outer facing means extending the length of the other side edge of the panel, at least a portion of said recess means being substantially parallel to the outer facing means for receiving said fastening means; said recess means being thicker than said flange means, whereby, when two panels are interconnected side edge to side edge, said flange means of one panel extends into said recess means of the second panel to define a substantially rectilinear continuation of the outer surface of the panels and a flow passage between said flange means and recess means.

8. A wall structure according to claim 7, wherein each said panel includes connecting strips on the outer surface of said inner facing means for mounting the panel on said structural supporting means without penetrating said outer facing means.

9. A wall structure according to claim 7, wherein said fastener means are self tapping screws.

10. A wall structure according to claims 7, which is resistant to side joint disengagement and exposure of core means for a minimum ten minute duration when subjected to ULC Fire Test Type CAN-4-S101-M82.

* * * * *